US005267902A

United States Patent [19]

Arzberger et al.

[11] Patent Number: 5,267,902

[45] Date of Patent: Dec. 7, 1993

[54] SLITTING CUTTER

[75] Inventors: Maximilian Arzberger, Iggenhausen; Johann Haberer, Schrobenhausen, both of Fed. Rep. of Germany

[73] Assignee: Bauer Spezialtiefbau GmbH, Schrobenhausen, Fed. Rep. of Germany

[21] Appl. No.: 507,838

[22] Filed: Apr. 12, 1990

Related U.S. Application Data

[63] Continuation-in-part of Ser. No. 236,852, Aug. 26, 1989, Pat. No. 4,934,978.

[30] Foreign Application Priority Data

Aug. 28, 1987 [DE] Fed. Rep. of Germany ..... 3728866

[51] Int. Cl.[5] ..... F16D 3/76

[52] U.S. Cl. ..... 464/89

[58] Field of Search ..... 464/75, 89, 90, 92, 464/93, 180; 175/91, 96

[56] References Cited

U.S. PATENT DOCUMENTS

| | | | |
|---|---|---|---|
| 2,174,223 | 9/1939 | Frauenthal et al. | 464/89 |
| 2,880,599 | 4/1959 | Hlinsky | 464/89 |
| 2,956,187 | 10/1960 | Wood | 464/89 X |
| 3,113,625 | 12/1963 | Conover | 464/89 X |
| 3,174,148 | 6/1964 | Kayser | 464/89 |
| 3,428,155 | 2/1969 | Binder et al. | 464/92 X |
| 4,467,753 | 8/1984 | Lange | 464/89 X |
| 4,787,868 | 11/1988 | Hoshiba et al. | 464/180 X |

*Primary Examiner*—Daniel P. Stodola
*Assistant Examiner*—William G. Battista, Jr.
*Attorney, Agent, or Firm*—Keck, Mahin & Cate

[57] ABSTRACT

A rotation elastic damped cutting device of a slitting cutter with at least one cutting wheel and a driven shaft for driving the cutting wheel, allows absorption of an abrupt, shockproducing blocking force. A rotation elastic dampener is provided in a radial space between the driven shaft and the cutting wheel as a cylindrical bushing. The cutting wheel and the driven shaft are connected by at least one wall, respectively, and the elastomer is vulcanized on one of these walls. A circumferentially fixed metal sleeve is inserted between the elastomer and the other wall for causing a radial pressure on the elastomer, effecting a good friction grip between the elastomer and the metal sleeve.

7 Claims, 4 Drawing Sheets

SLITTING CUTTER

This application is a continuation-in-part of U.S. application No. 07/236,852, filed Aug. 26, 1989, now U.S. Pat. No. 4,934,978.

FIELD OF THE INVENTION

The present invention relates to a rotation-elastic damped cutting device of a slitting cutter having drive means for driving a driven shaft of the cutting device by means of an upstream clutch and a cutting wheel gear.

BACKGROUND OF THE INVENTION

U.S. Pat. No. 2,956,187 to Wood discloses a flexible coupling means directed to the compensation for slight misalignment between a generator and an exciter shaft. Therefore, the general object of Wood is to eliminate slight misalignments of "several thousandths of an inch". The flexible coupling taught by Wood is a nested coupling to reduce the axial length of the connection between the generator and the exciter shaft. The coupling and damping means is placed on a small diameter of the exciter shaft in comparison with the maximum diameter of the generator. Therefore, the radial outer circumferential surface of the rubber sleeve of Wood is even too small to overcome torsion loads which might be caused when starting the generator.

Therefore the coupling means disclosed by Wood is not adapted to be used in heavy load slitting cutters because the Woo coupling is constructed for use in small synchronous generators, in which high tension forces and quick replacement of the damping means in case of repair is not relevant.

U.S. Pat. No. 2,880,599 to Hlinsky discloses a vibration damping gear comprising an arrangement of axially stacked resilient disks and annular disks which are alternately located in the arrangement. This arrangement is penetrated by a fastening bolt which effects an axial pressure onto the annular and resilient disks. Under consideration of heavy shear stresses the resilient disk as well as the bolts themselves may be damaged. Furthermore, a vibration damping means without any axial fastening means is disclosed. Here the resilient disks completely fill the radial space between an inner hub and a ring gear. However, although this vibration damping means allows larger torsion movements of the ring gear with respect to the inner hub, the damping gear is not constructed to be used in heavy load machines, where an abrupt blocking of a cutting wheel can cause serious damage to the wheel gear.

U.S. Pat. No. 4,467,753 to Lange discloses a vibration dampener on an engine shaft. The motor mount for the shaft is incorporated in a pulley device having a pulley concentric with and spaced from the shaft so that the vibrations of the shaft and engine are not transmitted to the pulley. The pulley is supported by a journal carried on the tractor frame and the pulley is connected to the shaft through an annular layer of elastomer material that is fixed to rotate both with the pulley and the shaft and which dampens any shaft or engine vibration that might otherwise be transmitted to the pulley and to the frame. Even this vibration dampener is constructed for dampening little shocks, e.g. when starting the engine, and is therefore not able to dampen and transfer heavy shock loads as they appear in operation of a slitting cutter.

SUMMARY OF THE INVENTION

Thus it is a basic idea of the invention to integrate a damping means directly into the cutting wheels while improving the shock resistance of the damping means. The damping means contains an elastomer which is pressed in a radial direction by inserting a metal sleeve between the elastomer layer and the driven shaft of the cutting wheel. The circumferential fixation of the metal sleeve is effected by key and slot connections, whereby the keys do not protrude in a direction of the elastomer, above the surface of the metal sleeve which lies adjacent to the elastomer. The radial pressure of the elastomer causes a very intensive friction grip between the elastomer and the metal sleeve and the torsion resistance of the elastomer is improved because the biasing of the elastomer with the radial pressure has the effect that the critical shear and tensile force is increased by the radial pressure value.

The elastomer is disposed between walls which are alternately fixed to the driven shaft or the cutting wheel, respectively.

Advantageously, the walls are embodied as inner and outer hub rings which are reliably connected with the driven shaft or the cutting wheel, respectively. The connection can, e.g., be a screw connection. So the damping means can be replaced in case of operation or damage in a quick and easy manner, so that simple maintenance handling is obtained.

In an advantageous embodiment of the invention at least two circumferential walls are provided having a radial spacing between each other and the first wall is provided as at least one carrier ring engaging into the space between second circumferential walls, the elastomers are vulcanized on a radially inner and outer surface of the carrier ring respectively and extend in a radial direction with respect to the surfaces of the second circumferential walls. The load transmission between the driven shaft and the cutting wheel is improved by locating at least two circumferentially positioned elastomer layers with a radial distance disposed between the walls and which are alternately connected with the driven shaft of the cutting wheel, respectively. In this embodiment the surface which is relevant for the load transmission is enlarged so that critical shear and tensile stresses are obtained at higher blocking forces of the cutting wheel.

For ensuring a high load transmission between the driven shaft and the cutting wheel the damping means extend advantageously approximately over the total axial depth of the cutting wheel.

For preventing movement of the elastomer with respect to the second wall, a thrust washer might advantageously be provided at one axial end of the elastomer. This thrust washer can be screw connected with the second wall.

As the cutting wheels are conventionally axially designed with two or three cutting tooth sets, the bush-like damping member largely extends over the entire axial extension of the cutting wheel, so that different forces acting radially from the cutting teeth onto the driven shaft can be absorbed and transferred over a larger axial surface.

The radial thickness of the damping member can, e.g., be approximately 3 cm in the case of an inner radius in the fitted state of 50 cm, whereby the outer surface of the cutting wheel can have a radius of approximately 65 cm. The outer surface of the cutting wheel is so understood in this case that the corresponding fixing means for the cutting teeth are fitted and in particular welded thereto. It is particularly preferred for the damping member, to the extent that this is possible, to be radially outwardly displaced towards the cutting wheel circumference.

The metal sleeve can, e.g., comprise four sheet metal segments between which there are corresponding slots which engage the keys of the cutting wheel.

BRIEF DESCRIPTION OF THE DRAWINGS

The invention is described in great detail hereinafter relative to a non-limitative embodiment and the attached drawings, which show.

DETAILED DESCRIPTION OF THE PREFERRED EMBODIMENTS

Figure 1:
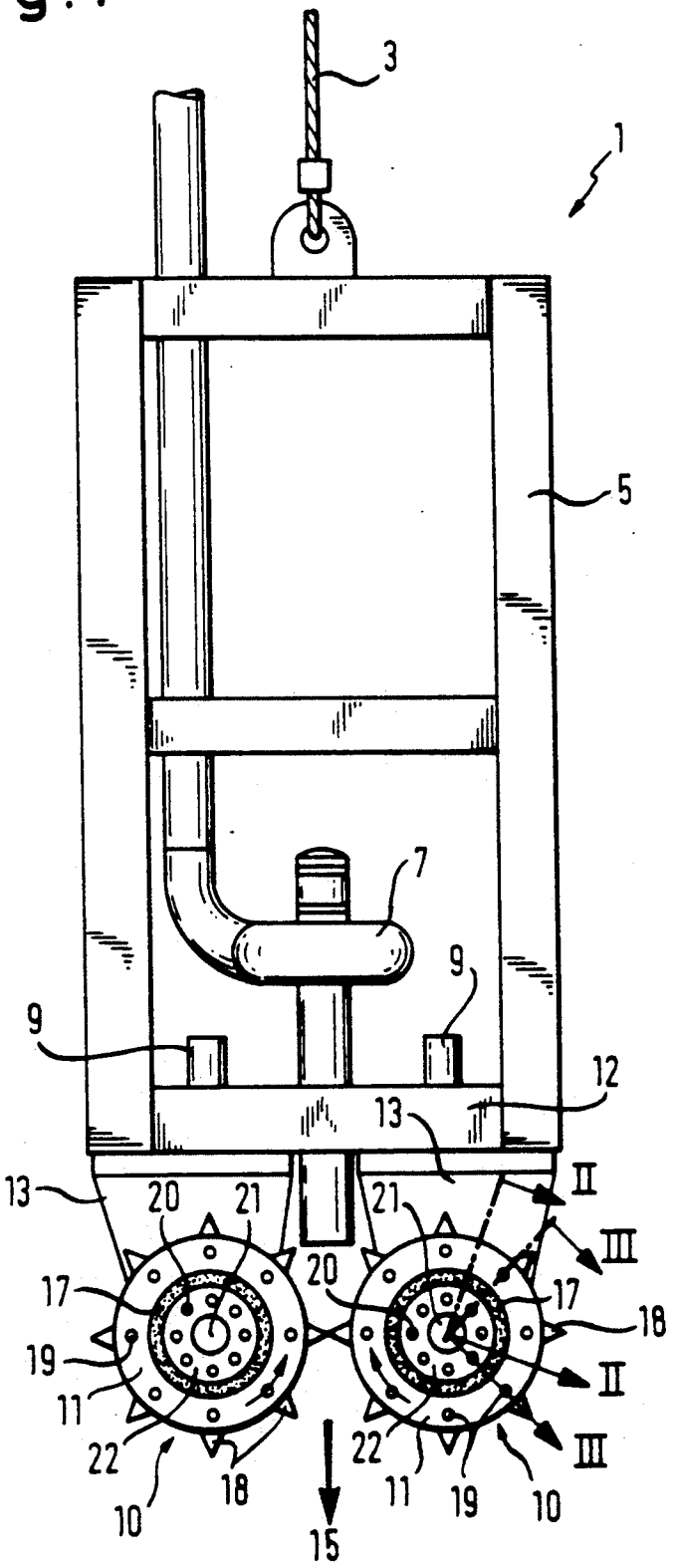
FIG. 1 is a side view of a slitting cutter with frontally represented cutting wheels.

FIG. 1 is a side view of a slitting cutter 1. The slitting cutter 1 has a support frame 5 which is held by a support cable 3. There is a suction device with pump 7 by means of which the detached ground material is conveyed upwards. There are also drive motors 9 for the cutting wheels 11 fixed to the support frame 5 which drive the cutting wheels 11 by means of the diagrammatically indicated gear 12. The two represented cutting wheels 11 are rotatably mounted in two bearing brackets 13 which are fixed to the cutting or support frame 5. During use the slitting cutter 1 is advanced in the direction of arrow 15. Conventionally on the other side of the bearing brackets 13, the slitting cutter 1 also has two cutting wheels. On its circumferential surface the cutting wheel 11 normally has several cutting tooth sets 10 which are arranged in axial succession on the driven shaft. The cutting tooth sets 10 are generally displaced somewhat in the rotation direction so that in an angularly displaced manner the corresponding cutting teeth 18 carry out the cutting process.

The cutting wheels 11 shown in FIG. 1 are provided with an elastomeric dampener 17 which is vulcanized in a radial space about the driven shaft 21 on a corresponding hub ring 22.

Figure 2:
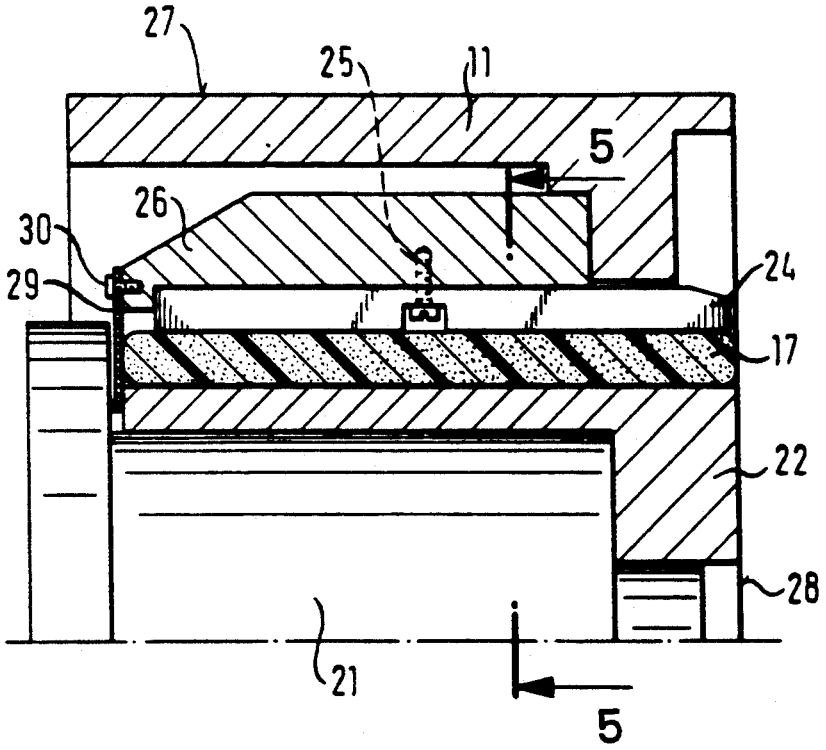
FIG. 2 is a radial section through a cutting wheel without cutting teeth in the vicinity of a key and slot connection along line II—II with the damping member and the driven shaft.
Figure 5:
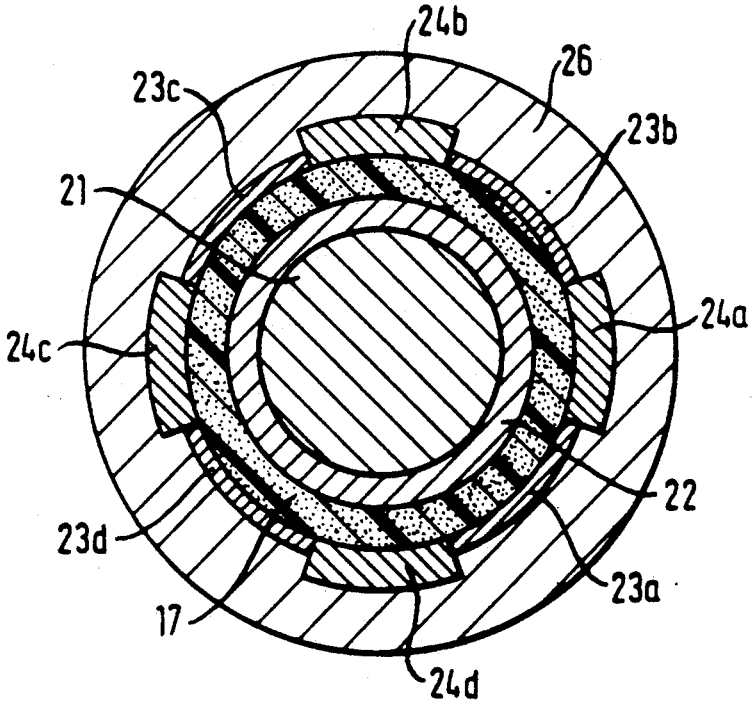
FIG. 5 is a cross-sectional view taken on line V—V of FIG. 2.
Figure 3:
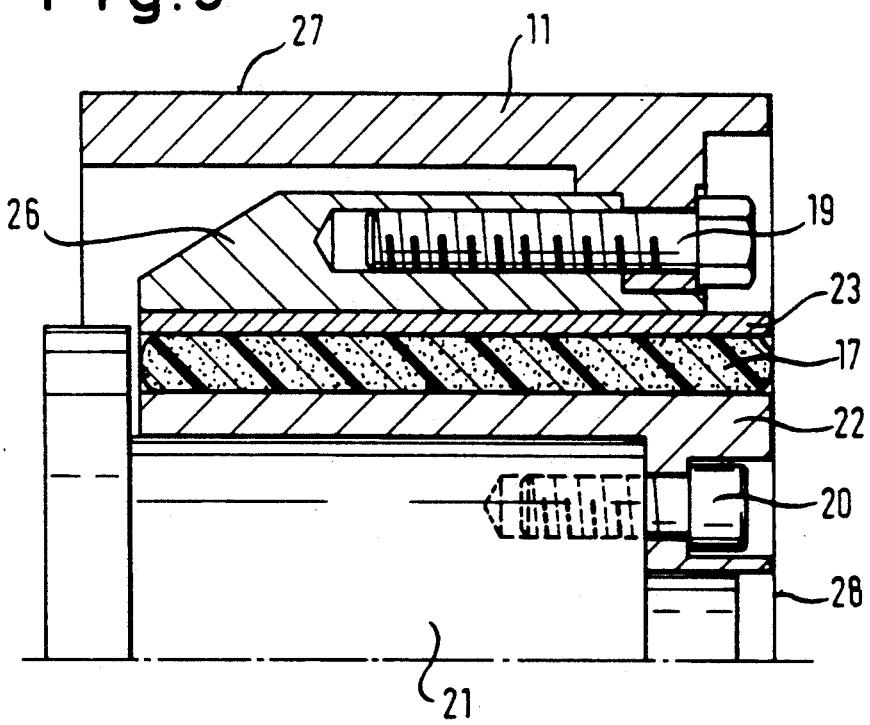
FIG. 3 is a radial section comparable with FIG. 2, but in the vicinity of the axial screw connections between the cutting wheel and driven shaft along line III—III.

With reference to FIGS. 2 and 3, the dampener member 17 is radially outwardly surrounded by sheet metal segments 23 which can also be designed as a metal sleeve. In practice four sheet metal segments 23 are sufficient and they are spaced from one another circumferentially over a corresponding slot. In accordance with FIG. 2, a corresponding key 24 engages in said slot and it is connected with a screw 25 to an outer hub part 26.

The damping member 17 which is, e.g., made from an elastomer with a shore A rubber hardness of approximately 55 and a tensile strength of approximately 15 to 30 N/mm$^2$, is firmly vulcanized in between the inner hub ring 22 and the radially outer sheet metal segments 23. Whilst the hub ring is connected in a non-rotary manner to the driven shaft 21 by means of a screw 20, the sheet metal segments 23 are positively connected in non-rotary manner to an outer hub part 26 by means of keys (FIG. 2). The fixing of the hub part 26 takes place from the front of the driven shaft 21 by means of expansion bolts 19 which engage with the cutting wheel 11.

The driven shaft 21 is shown diagrammatically and not with its realistic diameter in the drawings. In practice, the driven shaft diameter would be much larger than in the drawings. However, the construction is such that the screw connections 20,19 can be released from the face 28 and it is also possible to disassemble the complete subassembly of damping unit 17,22,23. The cutting wheels 11 are shown in FIGS. 2 and 3 without the fixing means and cutting teeth welded to the circumferential surface 27. Normally there are several cutting tooth sets 10 extending in the axial direction on the circumferential surface 27 of the cutting wheels 11.

In the case of an abrupt stoppage and jamming of the cutting wheels 11 in the rotation direction of the drawn-in arrows (FIG. 1) the torque resulting from the driven shaft 21 is circumferentially absorbed in the damping member 17 or is at least damped to such an extent that there is no shock-like stressing of the not shown cutting wheel gear following the shaft 21 in the direction of motor 9. The vulcanizing on of damping member 17 such that the deformation forces and shear forces which occur lead to no breaking away of the vulcanization joint between hub 22 and sheet metal segments 23.

In FIGS. 2 and 3 a thrust washer 29 is connected to the outer hub ring 26 by a screw connection 30. This thrust washer prevents an axial movement of the damping member 17 with respect to the metal sleeve 23 or the outer hub ring 26.

Figure 4:
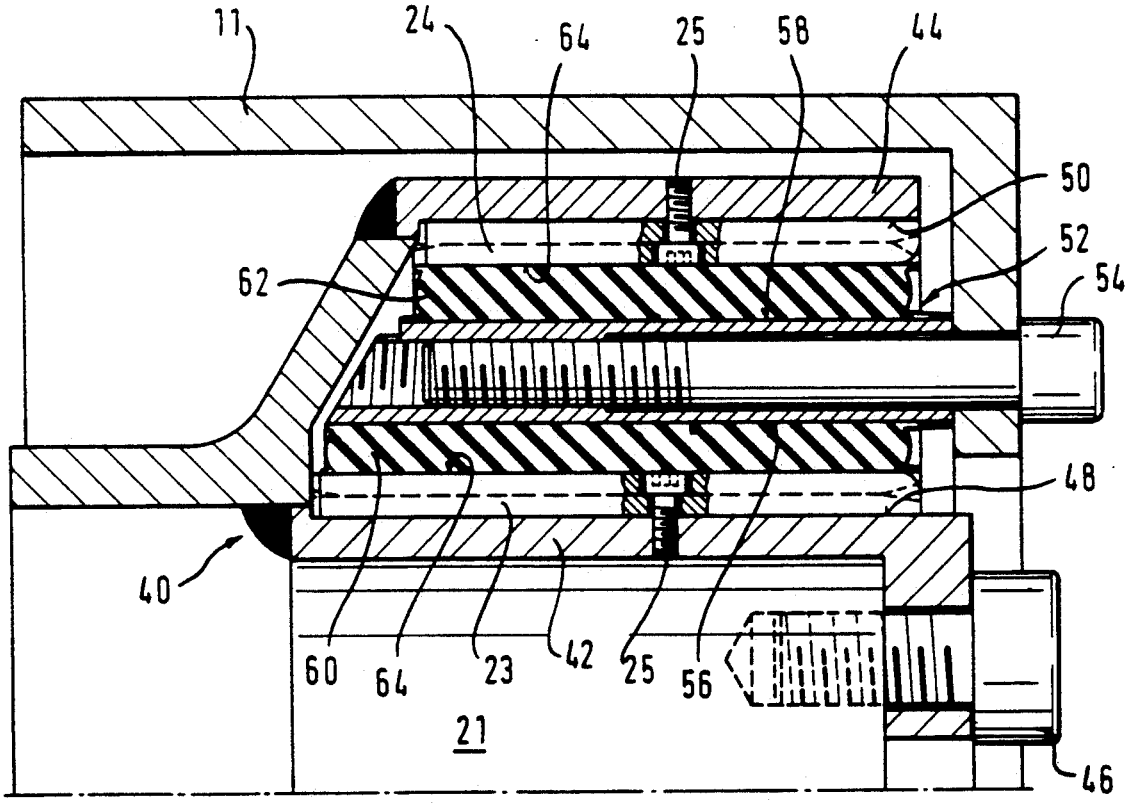
FIG. 4 is a radial section of another embodiment of the damping means with two elastomer layers having a radial distance.

FIG. 4 shows a radial section of another embodiment of the invention which is adapted to transmit heavy loads from the driven shaft 21 to the cutting wheel 11. Identical parts to FIGS. 2 and 3 with identical function are designated with identical reference numbers.

In this embodiment a hub ring 40 with two concentric circumferential walls 42,44 extending parallel to the axis of the driven shaft 21 are connected with screws 46 to the driven shaft 21. The walls 42,44 have surfaces 48,50 laying adjacent to each other and building a free space in between for engagement of a carrier ring 52 which is connected to the cutting wheel 11 by means of further screws 54.

The carrier ring 52 has radial inner and outer surfaces 56,58 on which inner and outer elastomer layers 60,62 are vulcanized. The elastomer layers 60,62 protrude in a radial direction to the surfaces 48,50 of the walls 42,44 of the hub ring 40.

The surfaces 48,50 of the walls 42,44 carry circumferential distributed keys 24 which are screw-connected 25 therewith. There are sector parts of a metal sleeve 23 positioned between the keys 24 connected with the walls 42,44. The inner surface of the metal sleeve 23 flushes substantially with the key edge 64 directed towards the elastomer layer 60,62.

The inner and outer elastomer layers 60,62 are radially pressed by insertion of the sector parts of the metal sleeves 23 between the keys 24 in such a way that an effective friction grip between the elastomer layers 60,62 and the metal sleeves 23 is obtained.

Because of the enlarged gripping surface, the damping means according to the embodiment shown in FIG. 4 is adapted to transmit higher loads in comparison with the embodiments shown in FIGS. 2 and 3.

We claim:

1. A rotation-elastic damped cutting device of a slitting cutter having drive means for driving a driven shaft of said cutting device, said rotation-elastic damped cutting device comprising:

a cutting wheel having cutting teeth, a rotation-elastic damping means, provided in a radial space between said driven shaft and said cutting wheel as a cylindrical bush for absorbing shock imparted to said cutting teeth, said damping means being an elastomer disposed between a first wall and a second wall, said first wall being connected in a fixed manner to said driven shaft, and said second wall being connected in a fixed manner to said cutting wheel, said elastomer being vulcanized on said first wall, and at least one metal sleeve segment, located between said elastomer and said second wall, said at least one metal sleeve segment being fixed with respect to said second wall in a circumferential direction by at least one key, extending parallel to the axis of said driven shaft, said at least one key being mounted in circumferentially distributed fixed positions at said second wall, said at least one key engaging into slots between ends of said at least one metal sleeve segment, and inner radial surfaces of said at least one key and said at least one metal sleeve segment causing a radial pressure on an outer surface of said elastomer, effecting a friction grip therewith.

2. A device according to claim 1, wherein a thrust washer is provided at one axial end of said elastomer for preventing an axial movement of said elastomer with respect to said second wall.

3. A device according to claim 2, wherein the thrust washer is screw-connected with the second wall.

4. A device according to claim 1, wherein said first wall being an inner hub ring, releasably connected with said driven shaft, and said second wall being an outer hub ring, releasably connected with said cutting wheel.

5. A device according to claim 1, wherein the ends of said keys protruding in the direction of said elastomers are flush with the inner diameter of said metal sleeve.

6. A device according to claim 1, wherein the damping means extend approximately over the total axial depth of said cutting wheel.

7. A rotation-elastic damped cutting device of a slitting cutter having drive means for driving a driven shaft of said cutting device, said rotation-elastic damped cutting device comprising:

a cutting wheel having cutting teeth, rotation-elastic damping means, provided in a radial space between said driven shaft and said cutting wheel as a cylindrical bush for absorbing shock imparted to said cutting teeth, said damping means being an elastomer disposed between a first wall, connected in a fixed manner to said driven shaft, and a second wall, connected in a fixed manner to said cutting wheel, said elastomer being vulcanized on said first wall, four metal sleeve segments, located between said elastomer and said second wall, said metal sleeve segments being fixed with respect to said second wall in a circumferential direction by four keys, extending parallel to the axis of said driven shaft, said keys being mounted in circumferentially distributed fixed positions at said second wall, said keys engaging between said metal sleeve segments, and inner radial surfaces of said keys and said metal sleeve segments causing radial pressure on an outer surface of said elastomer, effecting a friction grip therewith.

* * * * *